US006681734B2

(12) United States Patent
Albertson

(10) Patent No.: US 6,681,734 B2
(45) Date of Patent: Jan. 27, 2004

(54) HYDRAULIC CYLINDER DEACTIVATION WITH ROTARY SLEEVES

(75) Inventor: William Conrad Albertson, Clinton Township, MI (US)

(73) Assignee: General Motors Corporation, Detroit, MI (US)

( * ) Notice: Subject to any disclaimer, the term of this patent is extended or adjusted under 35 U.S.C. 154(b) by 136 days.

(21) Appl. No.: 10/061,666

(22) Filed: Feb. 1, 2002

(65) Prior Publication Data

US 2003/0145722 A1 Aug. 7, 2003

(51) Int. Cl.[7] ..... F01L 1/34

(52) U.S. Cl. ..... 123/90.16; 123/90.5; 123/90.39; 123/90.48

(58) Field of Search ..... 123/90.39, 90.4, 123/90.41, 90.42, 90.43, 90.12, 198 F, 481, 90.35, 90.36, 90.55, 90.48, 90.5, 90.49, 90.16, 90.51, 90.52, 90.53

(56) References Cited

U.S. PATENT DOCUMENTS 4,083,334 A * 4/1978 Roncon ..... 123/90.35
4,336,775 A * 6/1982 Meyer ..... 123/198 F
4,414,935 A * 11/1983 Curtis et al. ..... 123/198 F
4,887,566 A * 12/1989 Shida ..... 123/90.51
6,321,704 B1 * 11/2001 Church et al. ..... 123/90.16

* cited by examiner

*Primary Examiner*—Thomas Denion
*Assistant Examiner*—Jaime Corrigan
(74) *Attorney, Agent, or Firm*—Leslie C. Hodges

(57) ABSTRACT

Cylinder deactivation apparatus includes switching valve actuators controlled by rotary valve sleeves surrounding each of the actuators. In a preferred embodiment, the sleeves act to admit continuous pressurized oil to internal lash adjuster mechanisms and selectively control oil flow from a lash adjuster mechanism inlet to a deactivator switching mechanism and discharge of pressure oil from the deactivator switching mechanism. A single oil supply provides pressurized oil to both conventional and deactivation valve actuators for lubrication of associated valve mechanisms and operation of internal lash adjusters as well as for operation of the cylinder deactivation mechanisms. In a valve-actuating position, the rotary sleeve drains oil from the deactivating mechanism so that associated engine valves are operated normally. In a deactivating position, the sleeve closes an exhaust port and transfers oil from the lash adjuster oil feed to the deactivation mechanism to deactivate the engine valves of the deactivation cylinders.

8 Claims, 3 Drawing Sheets

HYDRAULIC CYLINDER DEACTIVATION WITH ROTARY SLEEVES

TECHNICAL FIELD

This invention relates to engine cylinder deactivation apparatus and, in particular, to apparatus having switching valve actuators controlled by rotary valve sleeves.

BACKGROUND OF THE INVENTION

It is known in the art of engine cylinder deactivation to provide switchable hydraulic valve actuators operable to either actuate the valves of a deactivation cylinder or to maintain the valves closed through lost motion features of the valve actuators. The valve actuators may be either stationary hydraulic lash adjusters or hydraulic valve lifters, both of which may include internal hydraulic lash adjusting mechanisms and so may be referred to broadly as a hydraulic lash adjusters or valve actuators.

Conventional valve actuators having lash adjusters are supplied with pressurized oil through a lash adjuster gallery or lifter gallery to annular feed grooves or intake ports. The pressurized oil operates with the lash adjusting mechanisms to take up lash in the valve train between the valve and its associated tappet or other actuator. Valve actuators with cylinder deactivation may have an additional port for a lock pin which connects through control passages and a control channel with a valved oil pressure supply. A three-way solenoid-actuated hydraulic control valve may be used to connect oil pressure to unlatch the lock pin for cylinder deactivation or switching of the valve actuators in a supply mode of the three-way valve, and to exhaust oil pressure from the oil passages and control gallery in an exhaust mode to return to normal engine valve operation.

Such cylinder deactivation apparatus typically use complex systems of bypass channels and hydraulic bleeds in order to purge air or other gas/vapor from the system to insure consistent response to control signals. This is necessary to provide reliable actuation or deactivation of the switchable hydraulic valve actuators in the apparatus when the hydraulic control valve is actuated to make a change in operation. These bleed and bypass systems may add considerable complexity to the deactivation apparatus itself. Thus, a simplified system for purging gas/vapor, primarily air, from the hydraulic cylinder deactivation apparatus is desired.

SUMMARY OF THE INVENTION

The present invention provides cylinder deactivation apparatus having a simplified hydraulic circuit featuring a single oil supply which supplies oil to both conventional and deactivation valve actuators for lubrication of associated valve mechanism and the operation of internal lash adjusters. The single oil supply further provides oil to cylinder deactivation mechanisms in the switching valve actuators. Rotary valve sleeves are provided surrounding each of the switching valve actuators. The sleeves act to admit continuous pressurized oil to the internal lash adjuster mechanisms and to selectively control the flow of oil from the lash adjuster mechanism inlets to the deactivator switching mechanisms, as well as to control the discharge of pressure oil from the deactivator switching mechanisms.

When a rotary sleeve is positioned in a first valve actuating position, an exhaust port in the rotary sleeve is aligned to drain oil from the deactivating mechanism while pressure oil to the mechanism is cut off so that the associated engine valves are operated normally. Rotation of the rotary sleeves to a second deactivation position closes the exhaust port flow and opens a transfer port from the lash adjuster oil feed to the deactivation mechanism to supply it with full pressure oil. This operates the deactivation mechanism, switching the lifter to the deactivated mode, which cuts off actuation of the valves by the switching valve actuators by unlatching their latch pins or lock pins and allowing the deactivation mechanism to telescope inside the valve actuator. In this way, control of the valve actuators and the actuating oil flow is concentrated at the rotary valve sleeves and the connecting hydraulic supply and exhaust passages adjacent to the valve actuators. A simplified internal passage system is thus provided with activation by rotary valves at each of the switching actuators. Simple linkages or actuating arms may be provided for rotating the rotary sleeves and may include separate drivers for each of the switchable engine cylinders.

These and other features and advantages of the invention will be more fully understood from the following description of certain specific embodiments of the invention taken together with the accompanying drawings.

DESCRIPTION OF THE PREFERRED EMBODIMENT

Figure 1:
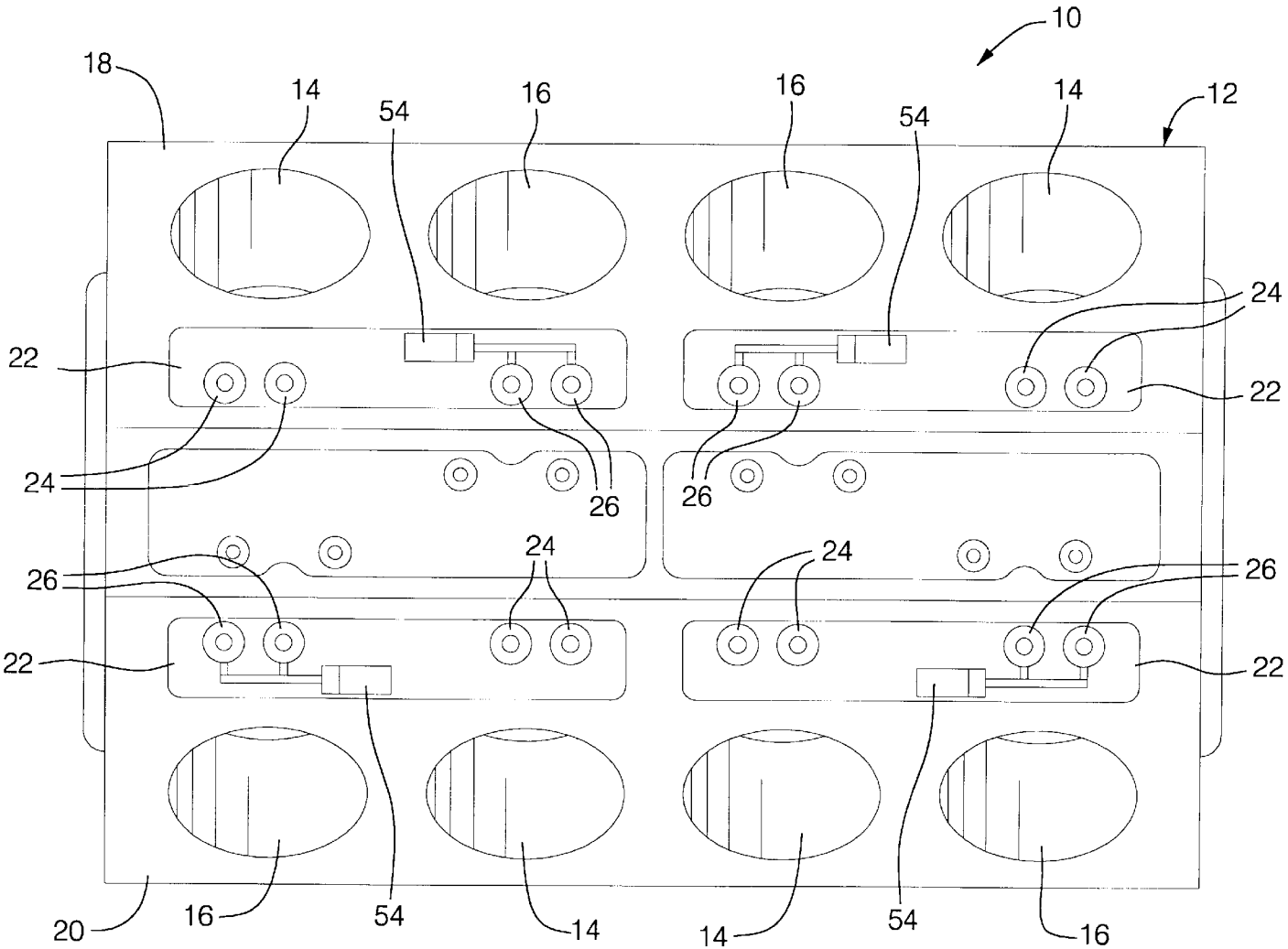
FIG. 1 is a top view of an engine with the cylinder heads removed showing the locations of conventional and deactivating valve actuators in accordance with the invention.

Referring first to FIG. 1 of the drawings in detail, numeral 10 generally indicates portions of an internal combustion engine having a cylinder block 12 including a plurality of cylinders separated into conventional cylinders 14 and the deactivation cylinders 16. The engine is illustrated without the cylinder heads in which the engine intake and exhaust valves and a substantial portion of the valve actuating mechanism or valve train are mounted. The valve mechanism may be of any known type for actuating engine valves depending upon the particular type of engine in which a cylinder deactivation function is to be utilized.

In the illustrated embodiment the engine has two opposite cylinder banks 18, 20. In these are located valve actuator galleries 22 in which both conventional valve actuators and switching valve actuators 24, 26 are mounted. These actuators may either be of the stationary hydraulic lash adjuster type which are commonly used for overhead cam engines or the roller hydraulic valve lifter type which are commonly used for camshaft in block engines.

Figure 2:
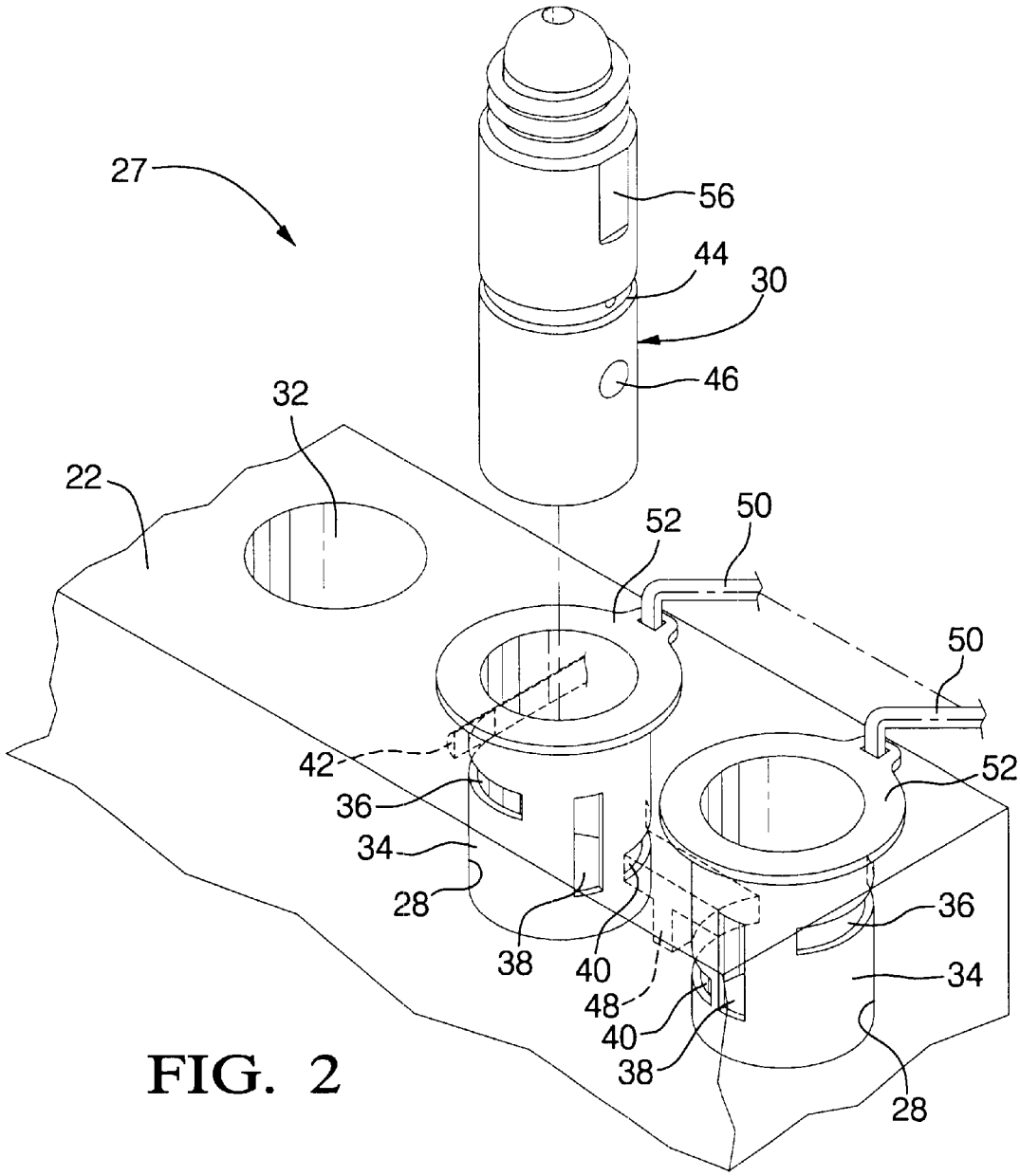
FIG. 2 is an exploded pictorial view illustrating schematically an arrangement of rotary valve sleeves for controlling oil flow in a deactivating lash adjuster according to the invention.

Referring now to FIG. 2, there is shown a deactivation apparatus 27 including the valve actuator gallery 22 portion of a cylinder block 12. Gallery 22 includes bores 28 in which valve actuators of the stationary switching lash adjuster type 30 are received and bores 32, only one of which is shown, for receiving conventional stationary switching lash adjusters, not shown. The conventional lash adjusters are received directly in the bores 32 and are provided with hydraulic fluid in the form of lubricating oil through supply passages in the actuator gallery that supply pressurized oil to internal lash adjusting mechanisms within the conventional lash adjusters. The switching lash adjusters 30 are received within rotary valve sleeves 34 which are in turn mounted in the bores 28 formed within the lifter gallery 22.

The rotary sleeves 34 are generally cylindrical and each includes a feed port 36, a transfer port 38 and an exhaust port 40. The feed ports 36 receive pressurized oil from supply ports or passages 42 of the actuator gallery and conduct it directly to annular inlet grooves 44 in the actuator bodies that feed the pressurized oil to internal lash adjusting mechanisms of the lash adjusters 30. The transfer ports 40 connect between the feed ports 36 of the lash adjusters 30 and inlet openings 46 of the lash adjuster switching or deactivation mechanisms when the rotary sleeves 34 are turned to a deactivation position, shown in the figure, to supply the pressurized oil to the deactivating mechanism. The exhaust ports 40 connect the deactivation mechanism inlet openings 46 with exhaust passages 48 in the lifter gallery when the rotary sleeves 34 are rotated to an exhaust position to drain oil from the deactivation mechanisms and return the switching lash adjusters to their valve operating conditions.

In order to rotate the rotary sleeves 34 between their normal and deactivation positions, actuator rods 50 are provided which connect with upper rim portions 52 of the rotary sleeves. The actuator rods 50 may be operated by any suitable driver, one example of which, shown in FIG. 1, is a hydraulic cylinder 54, one for each pair of switching actuators 26 of the deactivation cylinders 16. If desired, the hydraulic cylinders 54 could be replaced by other forms of actuators such as electric solenoids. Also, a single actuator could be arranged to operate the switching valve actuators of several adjacent cylinders through a suitable actuator rod or linkage arrangement.

In operation, when the rotary sleeves 34 are rotated to their normal operating positions, pressure oil is cut off from the deactivation mechanism inlet openings 46 which are instead connected to the exhaust passages 48 to drain oil from the mechanisms. In this condition, the deactivating mechanisms are latched and the valves of the associated cylinders are actuated normally by the valve gear. When it is desired to operate the engine on only the conventional cylinders 14, the rotary sleeves 34 are moved or rotated to their deactivation positions, shown in FIG. 2, where the transfer ports 38 connect with the inlet openings 46 and the lash adjuster annular inlets 44 to provide pressurized oil to the deactivation mechanisms to unlatch the mechanisms and deactivate valve operation for the associated cylinders.

Figure 4:
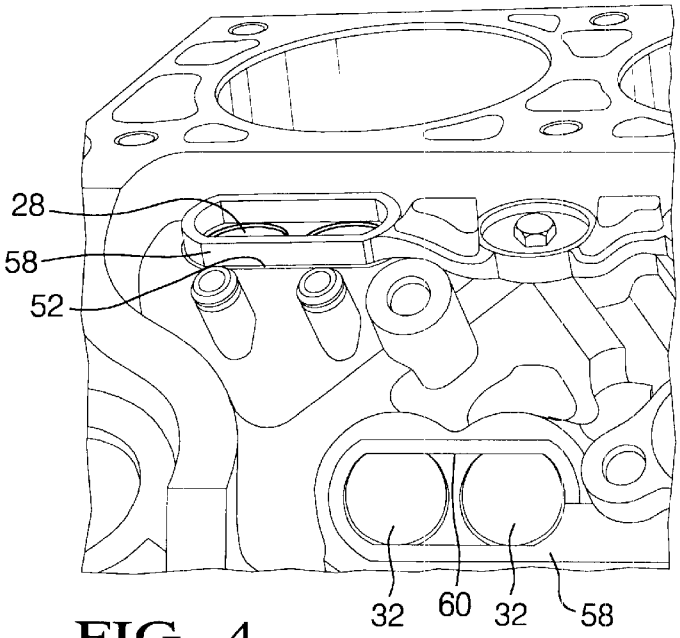
FIG. 4 is a pictorial view showing non-rotation guides for the valve actuators of an engine.

In order to keep the lash adjusters 30 from rotating with the rotary sleeves, the upper portions of the lash adjuster bodies are provided with flats 56 which are engaged by valve actuator guides 58, an example being shown in FIG. 4. Guides 58 extend above the rim portions 52 of the rotary sleeves 34 and include flat surfaces 60 which engage the flats 56.

Figure 3:
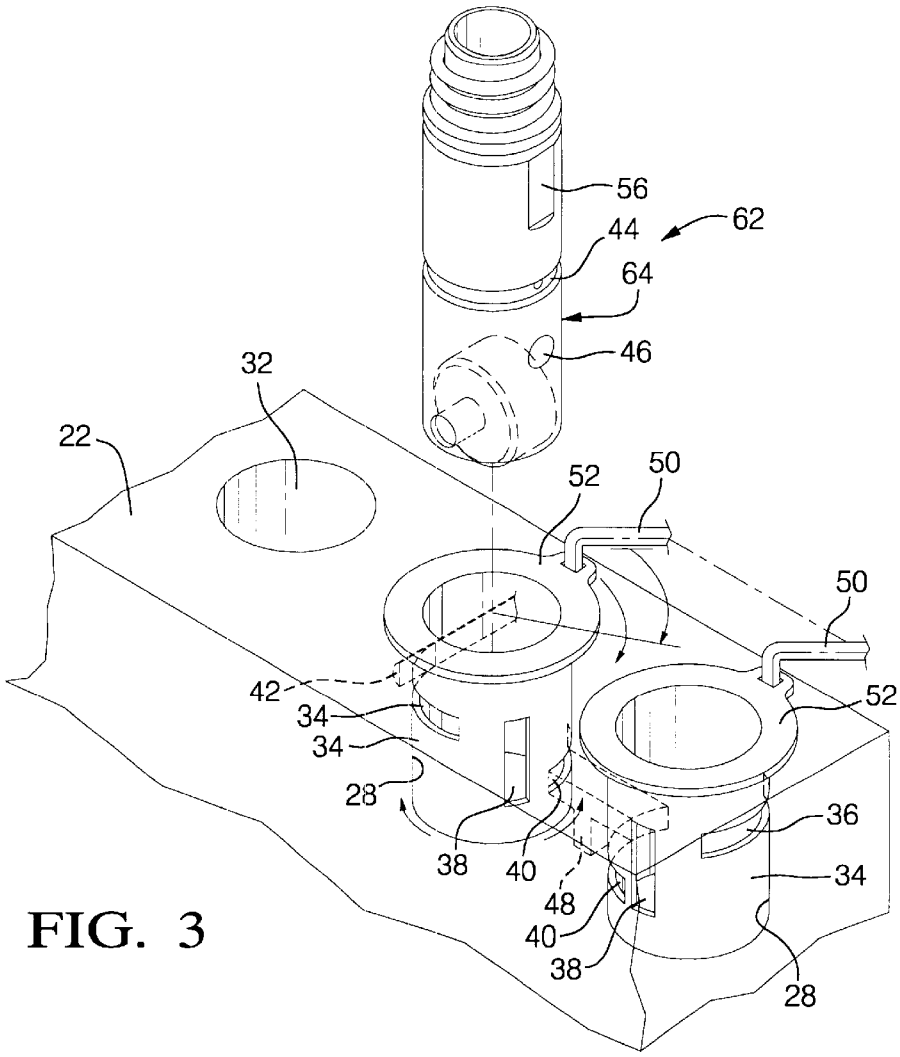
FIG. 3 is a pictorial view similar to FIG. 2 but showing a roller hydraulic valve lifter as the valve actuator.

Referring now to FIG. 3 of the drawings there is shown schematically a deactivation apparatus 62 similar to apparatus 27 of FIG. 2 and in which like numerals indicate like parts. Mechanism 62 differs from that of FIG. 2 in the use of valve actuators of the roller hydraulic valve lifter type 64. These roller lifters operate with the same internal mechanisms and external connecting elements as the switching lash adjusters 30 previously described. Accordingly, operation of the deactivation mechanisms for the roller lifters 64 is identical to that of the lash adjusters 30 previously described so that further description is not believed necessary.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. Cylinder deactivation apparatus for an engine having multiple cylinders, said apparatus comprising:

a plurality of valve actuators for actuating respective valves of the multiple cylinders, some of said actuators being switchable between valve actuating and valve deactivating conditions wherein the respective valves are operated normally in the valve actuating conditions and are deactivated to remain closed in the deactivating conditions;

a gallery having bores for receiving said valve actuators and including supply and exhaust passages for supplying and discharging pressurized hydraulic fluid to and from the switchable actuators for switching their conditions; and rotary valve sleeves between each of the switchable valve actuators and their respective bores, the sleeves being rotatable between on and off positions operative respectively to discharge fluid from the switchable actuators for normally actuating the associated valves and to maintain pressurized fluid in the switchable actuators for deactivating the associated valves.

2. Apparatus as in claim 1 wherein said sleeves each include a feed port and an exhaust port, the feed port connectable between a gallery supply passage and the respective switchable actuator to conduct pressurized fluid for deactivating the actuator, and the exhaust port connectable between a gallery exhaust passage and the respective switchable actuator for selectively discharging fluid for reactuating the actuator.

3. Apparatus as in claim 2 wherein said sleeves are rotatable by an actuator mechanism including a drive unit connected with a plurality of said sleeves for simultaneous actuation of said plurality of sleeves.

4. Apparatus as in claim 3 wherein a separate drive unit is connected to actuate the sleeves of each cylinder.

5. Apparatus as in claim 2 wherein said switchable actuators each also include a lash adjusting mechanism, each said feed port continuously connecting the respective gallery supply port with an inlet of the lash adjusting mechanism of the respective actuator and each of the sleeves including a transfer port for selectively connecting said inlet with the respective switchable actuator to selectively conduct pressurized fluid for deactivating the actuator.

6. Apparatus as in claim 1 including guide means for preventing rotation of said switchable valve actuators in said gallery bores.

7. Apparatus as in claim 1 wherein said switchable actuators are hydraulic valve lifters.

8. Apparatus as in claim 1 wherein said switchable valve actuators are stationary hydraulic lash adjusters.

* * * * *